United States Patent [19]

Bolin

[11] Patent Number: 4,485,591

[45] Date of Patent: Dec. 4, 1984

[54] BLADE GRINDING MACHINE FOR REEL TYPE MOWERS

[76] Inventor: Robert L. Bolin, 1311 Burrow St., Humbolt, Tenn. 38343

[21] Appl. No.: 364,532

[22] Filed: Apr. 1, 1982

[51] Int. Cl.[3] ..... B24B 3/42

[52] U.S. Cl. ..... 51/48 HE

[58] Field of Search ..... 51/48 HE, 246, 249–250, 51/170 PT, 34 R, 34 C, 35, 36; 56/250, 12.1; 83/174; 76/82.1; 269/156

[56] References Cited

U.S. PATENT DOCUMENTS

| | | | |
|---|---|---|---|
| 642,275 | 1/1900 | Zacharias | 51/218 A |
| 2,180,911 | 11/1939 | Rogers | 51/48 HE |
| 2,187,289 | 1/1940 | Utterback | 51/48 HE |
| 2,281,055 | 4/1942 | Smith | 51/48 HE |
| 2,377,126 | 5/1945 | Brown | 51/48 HE |
| 2,406,162 | 8/1946 | Pederson | 51/48 HE |
| 2,715,797 | 8/1955 | Fuller | 51/222 |
| 2,718,097 | 9/1955 | Bradley | 51/48 HE |
| 2,755,600 | 7/1956 | Smith | 51/48 HE |
| 2,777,258 | 1/1957 | Avra | 51/48 HE |
| 2,780,034 | 2/1957 | Turner | 51/48 HE |
| 2,879,629 | 3/1959 | Machovec | 51/48 HE |
| 3,061,980 | 11/1962 | Machovec | 51/48 HE |
| 3,126,675 | 3/1964 | McEwan | 51/48 HE |

*Primary Examiner*—Frederick R. Schmidt
*Assistant Examiner*—Robert Rose
*Attorney, Agent, or Firm*—Pitts and Brittian

[57] ABSTRACT

A grinding machine for releasable attachment to reel type mower units for the sharpening of the cutting components thereof. This grinding machine has a base which rests upon the ground with extensions therefrom for releasable attachment to the mower unit. A grinding head supported on the extreme end of arms is positionable in a sufficient number of directions such that a grinding wheel thereof may be brought into contact with the edge of the cutting elements whereupon the rotation of the grinding wheel brings about the sharpening of those cutting units. The grinding head components are mounted upon a carriage which is moved along the base in a direction parallel to the axle of the mower unit whereby the continuous length of each of the cutter elements may be sharpened. Further attachments are provided whereby the grinding machine may also be used to sharpen the bed knife of the mower unit. An adjustable anvil associated with the grinding wheel holds the cutting blade or the bed knife in the proper orientation to the grinding wheel during the grinding operation from one end thereof to the other.

8 Claims, 7 Drawing Figures

BLADE GRINDING MACHINE FOR REEL TYPE MOWERS

CROSS REFERENCE TO RELATED APPLICATION

"Reference is made to U.S. patent application Ser. No. 197,007, filed Oct. 14, 1980, now abandoned."

1. Technical Field

The present invention relates in general to machines for sharpening the blades of reel type grass mowers commonly used in multiples or gangs such as those used to mow golf course fairways and the like, and more particularly to a machine which is easily transported to the mower at any suitable location.

2. Background Art

Multiple gang, reel type mowers are commonly used when mowing extensive areas which require more careful mowing than may be accomplished by a rotary type mower. One typical application of such multiple gang reel mowers is in the mowing of fairways of golf courses and the like. For this application, the blades of the reel type mowers must be sharpened frequently in order to maintain a uniform and satisfactory cutting of the grass to achieve a smooth surface throughout the fairways.

The most common method of sharpening cutting blades of each gang is to remove that gang from the mower unit, transport the removed gang to a maintenance building and to lift the gang up to a grinding machine for the grinding of the individual blades. After the sharpening of the blades, the gang must then be removed from the grinder and returned to the location of the remainder of the mower unit which may be at some distant position on the fairway of a golf course.

Various grinding machines for sharpening the blades of grass mowers and the like have heretofore been developed. See, for example, Green, U.S. Pat. No. 630,697; Tallman, U.S. Pat. No. 684,128; Meyer, U.S. Pat. No. 1,154,712; Boling, U.S. Pat. No. 1,187,807; Carlson, U.S. Pat. No. 1,734,713; Barnes, U.S. Pat. No. 2,038,470; Roth, U.S. Pat. No. 2,244,976; Kingsley, U.S. Pat. No. 3,073,100; Markham, U.S. Pat. No. 3,677,316; Fleming U.S. Pat. No. 3,863,403; and Goering, U.S. Pat. No. 4,019,287. None of the above patents disclose or suggest the present invention.

Reference is also made to U.S. patent application Ser. No. 197,007 filed Oct. 14, 1980 now abandoned, wherein is disclosed one type of sharpening equipment that is transportable to the mower unit.

SUMMARY OF THE INVENTION

The present invention is directed towards improving upon prior machines for the sharpening of cutting blades of reel type grass mower gangs. According to the invention, a portable, highly efficient blade grinding machine has been developed which will sharpen the blades of the cutter reel of a reel type grass mower while the unit is resting on the ground at any location.

The blade grinding machine of the present invention has a base member for resting upon a support surface, such as the ground, and is provided with means for fastening this base to the frame of a reel type grass mower gang. The base means includes a pair of longitudinally extending guide members oriented along the length of the reel type mower, and a trolley means supported upon the guide members for back and forth longitudinal movement. A grinding wheel means is attached to the trolley means, and this grinding wheel means is provided with adjustments for moving the grinding wheel thereof into contact with the individual blades of the reel type mower and for adjusting the height of the grinding wheel above the base whereby the correct angle of grinding is achieved. The grinding wheel means further includes an adjustable arcuate stop or anvil which rides along each individual blade to maintain a proper orientation of the blade and the grinding wheel. Attachments are provided for supporting the bed knife of the mower gang for the sharpening thereof in a similar manner.

DESCRIPTION OF THE PREFERRED EMBODIMENT

Figure 1:
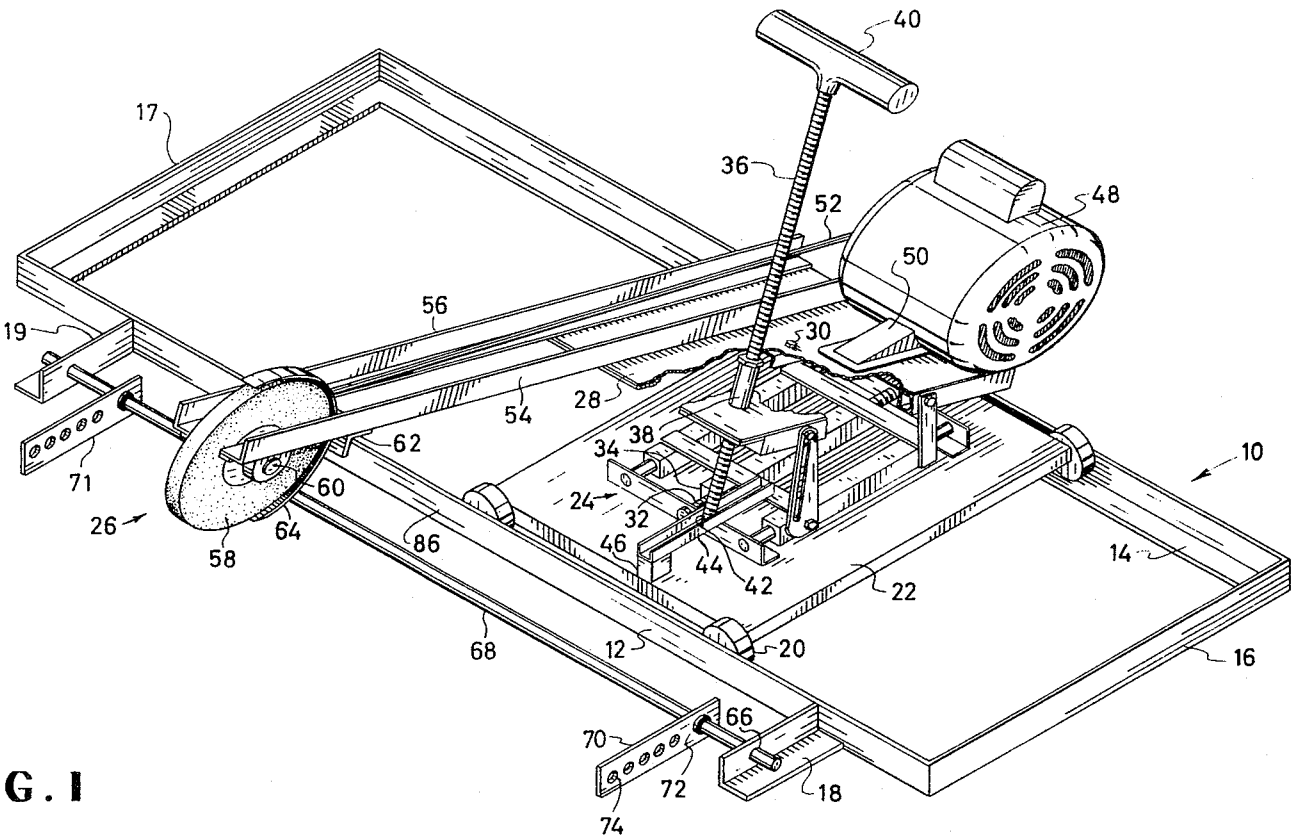
FIG. 1 is an isometric drawing, partly cut away, illustrating the blade grinding machine of the present invention.

The blade grinding machine of the present invention is illustrated in FIG. 1. This machine typically includes a base 10 for resting upon a support surface, such as the ground, and for being securely fastened to a frame of a mower gang. The base 10 includes a pair of longitudinally extending guide members 12, 14, preferably fixedly joined to one another by a pair of rigid end members 16, 17. The guide members 12, 14 may consist simply of a pair of opposed elongated metal angle members, and the end members 16, 17 may also consist of elongated metal angle members. The guide members and the end members are preferably fixedly attached to one another in any conventional manner such as by welding to form a rigid open rectangle as shown in this figure. A pair of short arm members 18, 19 are fixedly attached to the guide member 12 in spaced apart locations, and project from that guide member in a plane substantially that of the plane of the base 10. These arm members 18, 19 are a portion of the means for attaching the machine to a mower unit as discussed in more detail hereinafter with reference to FIG. 4. This portion of the base 10 is designated as the forward portion, and guide member 14 is the rearward portion of the base 10.

Supported upon the longitudinal guide members 12, 14 by means of a plurality of rollers 20 is a carriage 22.

As discussed in more detail hereinafter, the carriage 22 moves longitudinally in a back and forth motion on the base 10. Attached to the carriage 22 is an adjustment means 24 supported therefrom which provides for the positioning of a grinding means 26 with respect to a blade of a mower unit (shown in FIG. 5). Although this adjustment means 24 will be described in more detail hereinafter, certain of its components are described here to provide a more complete description of this FIG. 1. Attached to the upper portion of this adjustment means 24, which will be referred to hereinafter as a vise, is a flat plate 28 fastened thereto as with bolts 30. This plate 28 is positionable toward or away from the forward edge of the base 10 through the use of threaded screw 32 which engages a traveling nut 34. Furthermore, the plate 28 may be elevated or depressed through the use of a second screw 36 engaged with an internally threaded sleeve 38. The lower end 42 of the threaded member 36 engages a U-shaped channel 44 which is supported on a block 46 attached to the carriage 22. Thus, as the plate 28 is moved toward or away from the forward edge of frame 10 the end 42 of the threaded member 36 moves along this channel 44 whereby the elevation of the plate 28 is maintained constant during this movement.

Figure 5:
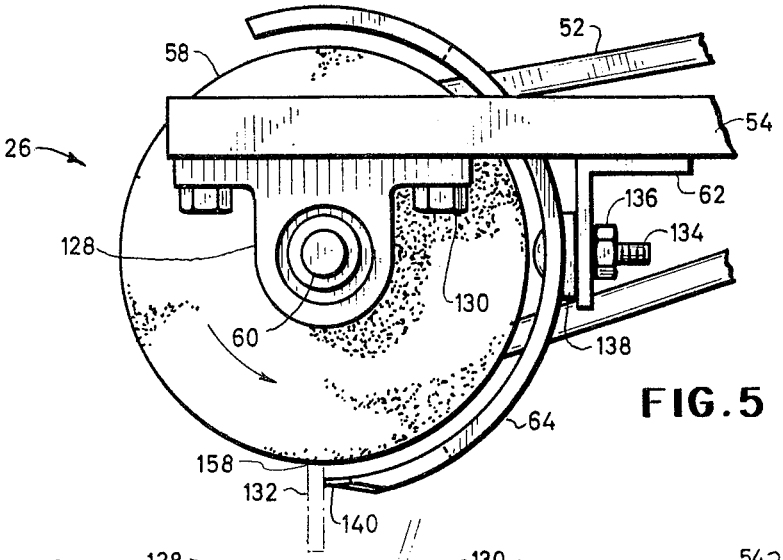
FIG. 5 is a side elevation of the grinding portion of a preferred embodiment of the present invention illustrating the relationship of the grinding wheel to an individual mower blade, and the adjustable stop or anvil for maintaining the relationship between the grinding wheel and the blade.
Figure 4:
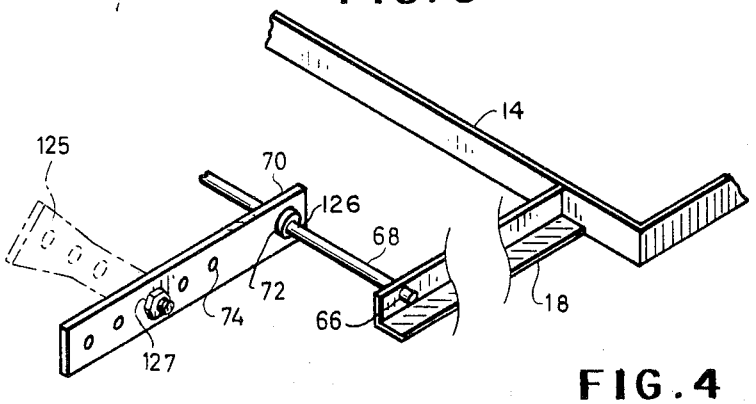
FIG. 4 is a fragmentary drawing illustrating a preferred construction of means for attaching the grinding machine of the present invention to a reel-type mower gang.

An electrical motor or other suitable rotating driving means 48 is suitable mounted upon the tiltable plate 28 with a bracket 50. This motor 48, through the use of an appropriate pulley (not shown), drives a rotatable belt 52 leading to the grinding means 26. Also fixedly attached to the tiltable plate 28 are a pair of arms 54, 56 which, as shown more clearly in FIG. 5, are used to support a grinding wheel 58 which is rotatably mounted on a shaft 60. This grinding wheel 58 and an appropriate second pulley (not shown herein) for the belt 52 are mounted at the outward end of these arms 54, 56 such that the grinding wheel 58 projects beyond the forward portion of the base 10. Immediately behind the grinding wheel 58 is a transverse bracket 62 which is attached to the arm 54, 56. This bracket 62 is provided for the mounting of a guide 64, the purpose of which is to position the grinding wheel 58 appropriately with respect to a cutter of the mower unit to be sharpened. Further details of this guide and the grinding means 26 will be given in discussion of FIGS. 5 and 6. Also shown in this FIG. 1 is the means for attaching the base 10 to a mower unit. The aforementioned arm members 18 which project from the base 10 are each provided with an aperture 66. Into these apertures is inserted a longitudinal rod 68. Pivotally positioned along this rod 68 are a pair of extension members 70, 71. These extension members 70, 71 have a bushing member 72 through which the rod 68 passes and are provided with a plurality of apertures 74 wherein a bolt may be inserted for the attachment of these extension members to the frame of a mower unit. Further details of attachment are shown in FIG. 4.

Figure 2:
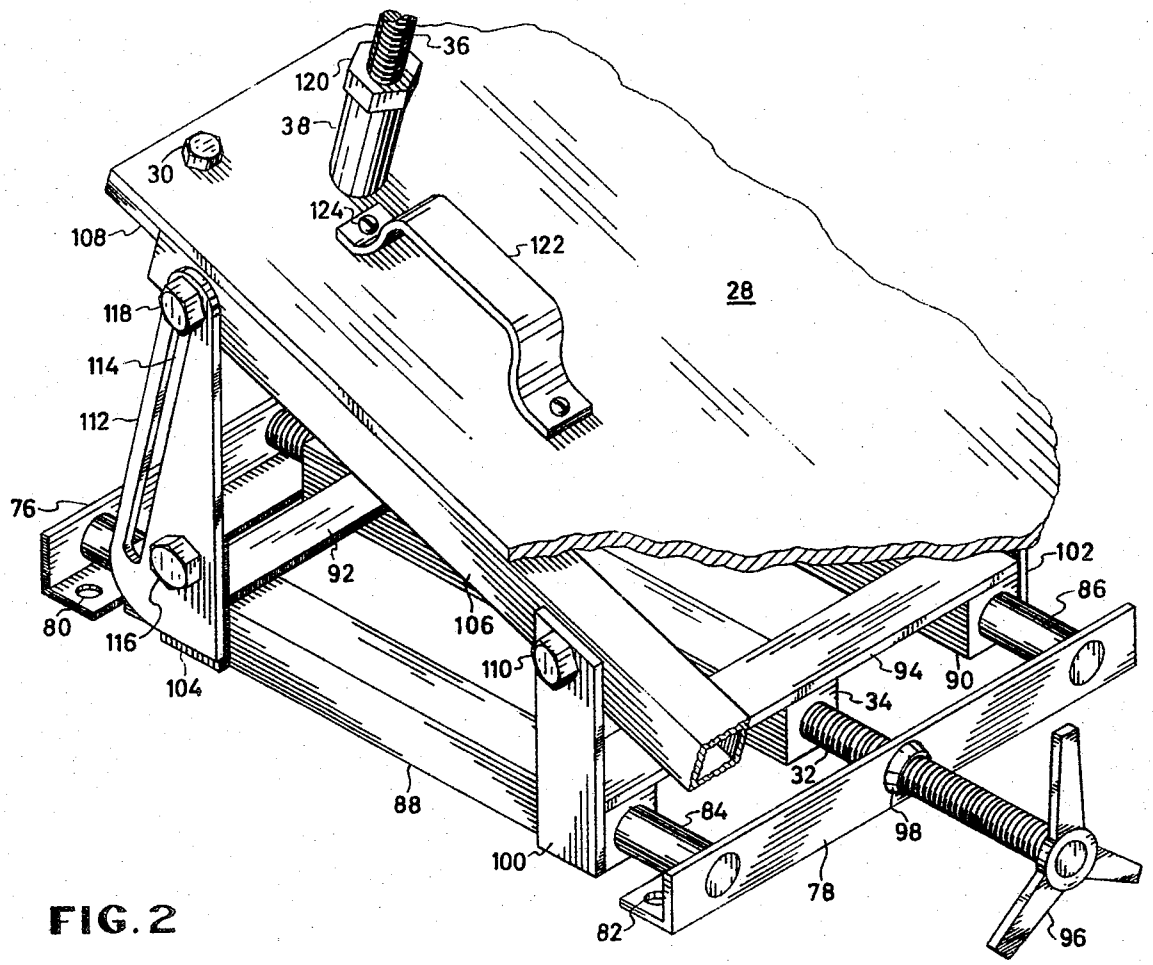
FIG. 2 is an isometric drawing, partly cut away, illustrating the vise portion of the machine of FIG. 1 that is used for adjusting the elevation and lateral movement of the grinding head.

Referring now to FIG. 2, shown therein are the details of the vise unit 24 which provides for the movement of the grinding means 26 relative to an item to be sharpened. This vise unit 24 is provided with a forward base mount 76 and a rearward base mount 78. Each of these elements is provided with appropriate apertures 80, 82, respectively for the attachment of these elements to the aforementioned carriage 22. Typically, this attachment is accomplished with bolts (not shown). Connected between the forward base mount 76 and the rearward base mount 78 are a pair of parallel slideway members 84, 86, which are fixedly attached to these base mount members at their ends. Slidably engaged with the sideways 84, 86 are corresponding slides 88, 90. Fixedly joined to, as by welding, and connecting the slides 88, 90 in a parallel relationship are cross bars 92 and 94 to form a slidable frame such that the slides 88, 90 move in unison along their respective slideways 84, 86. This movement is provided for by the aforementioned screw member 32 and the traveling nut 34 which is fixedly attached to these cross bars 92, 94. Operation of the screw 32 is provided for by the use of a handle 96. The screw 32 penetrates the rearward base mount 78, and a boss 98 or equivalent attached to the screw 32 permits the rotation of the screw within a clearance aperture in the base mount 78 without transverse motion of the screw relative to this rearward base mount 78. A similar boss (not shown) is provided on the screw 32 beyond the forward base mount 76. A pair of upstanding arms 100, 102 are fixedly mounted at the rearward ends respectively of the slide 88, 90. Furthermore, a pair of upstanding tabs 104 (only one shown) are fixedly mounted to the forward end of the slides 88, 90.

Pivotally mounted to the arms 100, 102 is a tiltable frame which is formed from a pair of side members (only one shown) 106 and a pair of end members (only one shown) 108. In this embodiment, the side member may be rectangular channels and the end members may each be an L-shaped member. It is to this frame that the tiltable plate 28 is attached using appropriate fasteners such as bolts 30. The side members 106 are pivotally joined to the upstanding arms 100, 102 with appropriate pivots such as bolt 110 passing through the tab 100 into the side member 106. The forward end of the frame is guided with a bracket 112 having a longitudinal slot 114 therein. The lower end of the bracket 112 is pivotally attached to the tab 104 as with the bolt 116, and a bolt 118 secured in the side member 106 engages the slot 114. It will be understood that a second bracket and corresponding pivots is provided on the opposite side of the frame. As discussed above, this forward end of the plate 28 is elevated or depressed through the use of a threaded member 36 which engages an internally threaded sleeve 38 or the like fixedly attached to the plate 28. An adjustable stop in the form of a jam nut 120 may be provided to ensure a positive positioning of the screw 36 within the sleeve 38. If desired, a handle 122 may be attached to the top of plate 28 using appropriate fasteners 124. This handle 122 provides a grasp for an operator whereby the aforementioned carriage 22 (see FIG. 1) may be moved along the guideways 12, 14.

Movements of the vise 24 and adjustments of the angle of the plate 28 are accomplished with the screws 32 and 36. Assuming a right handed thread on the threaded member 32, a clockwise rotation of the handle 96 causes the slides 88, 90 to move rearwardly, and a counter clockwise of the handle 96 causes the slides to move in a forward direction along their respective slideways 84, 86. Similarly, a right hand thread on threaded member 36 causes an elevation of the forward portion of tiltable plate 28 when the handle 40 (not shown in this figure) is rotated in a clockwise direction. A counter clockwise rotation of the handle 40 causes a lowering of the forward portion of the tiltable plate 28. During these up or down motions, the bolt 118 moves along the slot 114 in the bracket 112 and the bracket may pivot at bolt 116 if necessary.

The preferred embodiment of means for attaching the base 10 to a reel mower unit is illustrated in FIG. 4 (also shown in FIG. 1). The aforementioned bracket attached to the guide 12 (as well as a second bracket, not shown) is provided with the longitudinal rod 68 which passes through the aperture 66. Carried on this rod 68 is the pivotable extension arm 70 which is slidably engaged with the rod 68 by means of an aperture 126 in the boss 72. Furthermore, the arm 70 is provided with a plurality of apertures 74 whereby the grinding unit may be attached to mowers of differing dimensions. This advantage is also provided by the ability to slide the extension arms 70 axially along the rod 68. Shown with phantom lines in this FIG. 4 is a portion of a frame 125 of a mowing gang. The arm 70 is attached thereto with a bolt 127. For some mowers an additional interconnection bar may be utilized between the mower frame and the arm 70. It is to be understood that a second pivotable extension arm is carried on the rod 68 for attachment to a second end of the gang mower frame.

Figure 6:
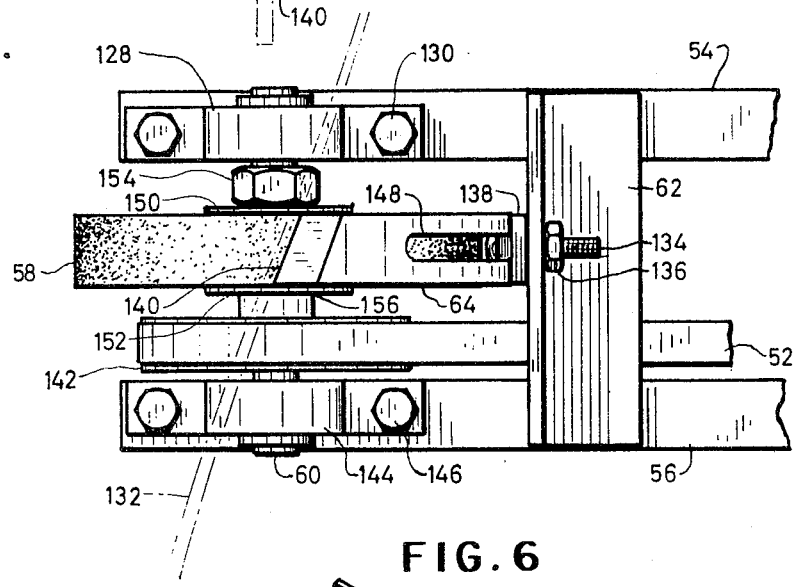
FIG. 6 is a bottom view of the unit illustrated in FIG. 5.

The preferred embodiment of the grinding means 26 of the grinding machine is illustrated in FIGS. 5 and 6. Referring first to FIG. 5, shown therein is an side elevation of the grinding means 26 of the grinding machine. The arm 54 is spaced apart from the arm 56 (see FIG. 5) a sufficient distance such that the grinding wheel 58 may be mounted therebetween. This mounting is accomplished by supporting the shaft 60 in an appropriate bearing member 128 mounted from the arm 54 with bolts 130, for example. Furthermore, in this preferred embodiment, a guide is illustrated for contacting a cutter blade 132 during the cutting operation. This guide comprises an arcuate blade or anvil 64 having an elongated slot (see FIG. 6), adjustably mounted by a bolt 134 and a nut 136 from the aforementioned bracket 62 which spans between the arm 54 and its corresponding arm 56. A spacer block 138 can be provided between the arcuate anvil 64 and the bracket 62 to properly space this anvil 64 relative to the periphery of the grinding wheel 58. Spacers of different thickness may be used to adjust this spacing. It may be seen that the extreme end 140 of the anvil 64 forms the support for the cutting blade 132 during the grinding operation, and that the location of this position can be adjusted by use of the aforementioned bolt 134 and nut 136.

Referring now to FIG. 6, the bottom view of the construction illustrated in FIG. 5 is shown. It may be seen that an outer pulley 142 for the belt 52 is also mounted between the arms 54, 56 adjacent the grinding wheel 58. The second end of the shaft 60 is mounted in a second bearing unit 144 which is attached to arm 56, for example, with bolts 146. As stated above, the arcuate anvil 64 is provided with a longitudinal slot 148 along a major portion of its length. This slot is provided to receive the aforementioned bolt 134 which holds the anvil at a selected position on the bracket 62. It may be seen in this FIG. 6 that the grinding wheel 58 is secured to the shaft 60 with a pair of washers 150, 152 and a nut 154. The nut 154 maintains the washer 152 in nonrotatable contact with a shoulder 156 on the shaft 60. Although not shown, the pulley 142 is typically secured to the shaft 60 with a conventional key and keyway. In this figure, it may be seen that a cutter blade 132 abuts the end 140 of the anvil 64 during grinding operations.

The operation of the present invention may be best described by reference to FIG. 1 when taken in combination with FIGS. 2, 4–6. This grinding machine may be taken directly to the location of a reel type mower gang and the base 10 thereof attached thereto using the construction shown in FIG. 1 (also FIG. 4). When attached in this manner, the base 10 is substantially parallel to an axle supporting the spiral cutting blades 132 of a mower as attached to generally circular webs supported on the mower axle.

Since the mower unit usually has transverse bars joining portions of its frame which interfere with access to the cutter blades 132 by the grinding wheel 58, the mower unit is normally inverted prior to the connection of the grinding machine. After the connection has been made between the extenion 70 and the frame portion 125 of the reel type mower gang, (and a second extension at the second end of the mower gang), the grinding wheel 58 is positioned adjacent an edge of a specific blade of the mower gang through the adjustment of the threaded rod 36 and the threaded member 32. This causes the grinding wheel 58 to contact the edge of the cutting blade 132 at a proper angle to achieve a satisfactory cutting edge 158 (see FIG. 5). When in this position, the blade 132 rests against the end 140 of the adjustable anvil 64 such that, as the grinding wheel 58 is rotated by the motor 48 and belt 52, the cutting blade 132 is drawn against the anvil end 140. The carriage 22 is thereafter moved along the guide members 12 and 14 using handle 122 whereby the grinding wheel 58 traverses the entire length of the cutting blade 132. Throughout this traverse, the direction of rotation of the grinding wheel 58 maintains the cutting blade 132 against the end 140 of the adjustable anvil 64. It will be understood by those versed in the art that because the blade 132 is spirally mounted on the mower, the reel of the mower rotates to progressively maintain the cutting blade 132 against this anvil end 140. Thereafter, a second of the plurality of the blades is rotated into position to achieve the proper preparation of the cutting edge thereon. It will be recognized by those versed in the art that if the relative position of the periphery of the grinding wheel 58 to the axle of the blades 132 is maintained constant, the blades will all be sharpened to have the same radius from the center of this axle throughout their length.

Figure 3:
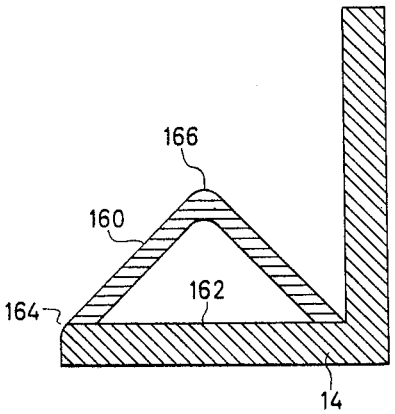
FIG. 3 is a cross-section of a second embodiment of guide members adapted for the machine of FIG. 1.

Since the cutting action along an individual blade is dependant upon the rollers 20 moving along the guides 12, 14, any accumulation of material on these guides will cause the grinding wheel 58 to grind a surface on the cutting blade 132 that is not at the correct radius from the axis of the mower. In order to minimize the accumulation of any foreign material on these guides 12, 14, a preferred construction is illustrated in FIG. 3. This is a cross-section, for example, of the rearward guide 14. In this embodiment, an inverted angle member 160 is attached in any suitable manner to the horizontal surface 162 of the guide 14. This attachment may be, for example, by welding along the intersection 164 between this member 160 and the surface 162. According to this construction, the angle member 160 provides an apex 166 for the support of the aforementioned rollers 20 of the carriage 22 (see FIG. 1). As shown, the edge adjacent the joint 164 may be rounded together with a rounding of the apex 166 to minimize the accumulation of material. Alternately, the lower portion of the guide member 14 may be reshaped to form the equivalent of the construction shown in FIG. 3. It will be understood that the forward guide member 12 will be formed in the same fashion as the guide member 14 shown in this figure.

During operation of a reel type mower, the individual blades progressively rotate and provide a cutting action between the edge thereof and a stationary cutter or bed knife that is maintained at a lower portion of the mower. The height of this bed knife is set to provide the appropriate length of grass to be cut. This bed knife often suffers damage due to rocks and other foreign material that may be caught between the rotating cutting blade and the bed knife. Thus, it is often necessary to refurbish the cutting edge of this bed knife. In accordance with this invention, an attachment is provided for the base 10 whereby the grinding wheel 58 and its positioning mechanisms may be utilized to achieve this refurbishing of the bed knife.

Figure 7:
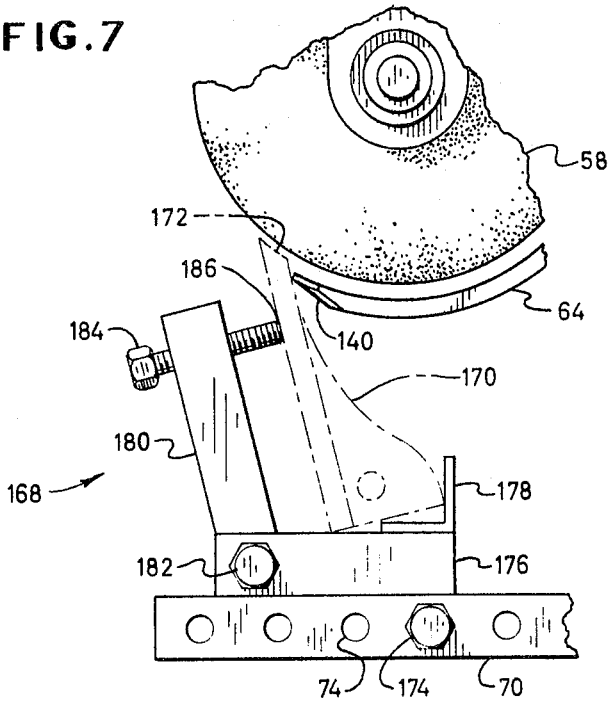
FIG. 7 is a drawing illustrating an attachment unit used for holding a bed knife of a reel type gang unit while sharpening the edge thereof with the present invention.

The attachment 168 is illustrated in FIG. 7, with a bed knife 170 shown in phantom lines having an edge 172 to be ground. It will be understood that two such attachments support the bed knife during grinding, with both attachments being substantially identical. Each of the attachments 168 is intended for releasable fastening to apertures in the extension arm 70 (as illustrated in FIG. 4). This is accomplished using a bolt 174 passing through one of the apertures 74 of the arm 70 and through a lower portion or base 176 of the attachment 168. An upper portion of this base 176 can rest upon the top edge of the extension arm 70 for stability. A transverse guide 178, which can be a section of L-shaped metal, is fastened by any suitable means, e.g., welding, to the attachment base 176 at an end toward the grinding machine. The opposite end of the attachment base 176 carries an upstanding arm 180. This arm 180, which also can be L-shaped in cross-section, is pivoted to the attachment base 176 with, for example, a bolt 182 which provides for adjusting the angular relationship between the arm 180 and the base 176. The opposite end of the arm 180 carries a threaded adjustment screw 184 oriented generally with an end 186 facing toward the grinding machine. The combination of the base 176, the guide 178 and the screw end 186 establishes the position of the bed knife 170 during the grinding of the edge 172 by the grinding wheel 58. The exact position is set by adjusting the screw 184 in one or both of the attachments 168. Other adjustment is provided by appropriately positioning the grinding wheel 58. During the grinding operation, the adjustable anvil end 140 contacts the bed knife 170 thereby properly supporting the bed knife for uniform grinding the edge 172 thereof.

From the foregoing, it will be recognized that a lightweight and thus a portable grinding machine has been provided for the sharpening of components associated with the cutting edges of reel type mower units. This grinding machine accordingly may be taken directly to the reel type gang mowers for sharpening of the components in the field with a considerable saving of time and effort. Since the grinding machine attaches to standardized reference points on the mower, accurate positioning of the grinding wheel with regard to the cutting members is achieved. The grinding wheel may be positioned with sufficient accuracy such that the desired angle of the cutting surfaces may be routinely achieved thereby optimizing the cutting behavior of the mower units.

It is, of course, understood that although a preferred embodiment of the present invention has been illustrated and described, various modifications thereof will become apparent to those skilled in the art. Accordingly, the scope of the invention should only be defined by the appended claims and the equivalence thereof.

I claim:

1. A portable grinding machine for the refurbishing of the cutting edge of a bed knife cutting element of reel type mowing units without removing said mowing units from mowing areas, which comprises:

base means including transverse guide members substantially parallel to said bed knife;

a transport carriage supported on said guide members of said base means and adapted for back and forth movement along the length of said guide members;

a grinding means carried by said carriage including a rotatable grinding wheel, means for rotating said grinding wheel about its axis of rotation, and an adjustable arcuate guide proximate a portion of the periphery of said grinding wheel to contact said bed knife during said back and forth movement of said carriage along said guide members to position said periphery of said grinding wheel relative to said cutting edge of said bed knife;

adjustable bed knife support means releasably connected to said base means, said bed knife support means having a pair of braces fixedly joined to and extending from said base means in the plane of said base means and in a direction perpendicular to said transverse guide members, said braces being provided with an aperture proximate the outer ends thereof;

a longitudinal rod received in said apertures of said braces;

a pair of pivotal arms carried by said rod and movable along the length of said rod between said braces, said pivotal arms being provided with apertures;

a support releasably attached to each of said pivotal arms, said support comprising an extension oriented along and attachable to said pivotal arm, a transverse stop carried at a first end of said extension, a generally upright arm having a first end attached to a further end of said extension, and an adjustment bolt carried by said upright arm at a second end, whereby said transverse stop, said extension and said adjustment bolt support said bed knife with said cutting edge of said bed knife directed toward said grinding wheel; and adjustment means connected between said carriage and said grinding means to position said grinding wheel relative to said cutting edge of said bed knife.

2. The grinding machine of claim 1 wherein said adjustment means connected between said carriage and said grinding means comprises:

a forward and a rear base mount attached to said carriage;

first and second parallel slideways joined between said forward and said rear base mounts in an orientation perpendicular to said guide members;

a first frame slidably engaged with said slideways;

a traveling nut carried by said first frame;

a rotatable screw, threadably engaged with said traveling nut, carried by said forward and rearward end base mount and extending rearwardly from said rear base mount;

a handle attached to said extending rotatable screw at the end thereof proximate said rear base mount;

a tiltable second frame pivotally attached at a rearward portion of said first frame;

a guide bracket provided with a longitudinal slot pivotally connected to said first frame at a forward end thereof with said slot engaging a pivot member on a forward portion of said second frame; and means for adjusting an angle between said second frame and said first frame.

3. The grinding machine of claim 1 wherein said carriage is provided with rollers for engagement with said guide members and wherein said guide members are inverted V-shaped members.

4. The grinding machine of claim 2 wherein said means for adjusting an angle between said second frame and said first frame comprises:

an internally threaded sleeve attached to said second frame;

a second rotatable threaded rod threadably engaged with said sleeve, said rod having a lower end bearing against said carriage; and a handle attached to an upper end of said rod above said second frame.

5. The grinding machine of claim 2 wherein said grinding means further comprises:

a pair of substantially parallel arms, each arm having a first end thereof fixedly secured to said second frame;

a transverse shaft rotatably mounted in further ends of said arms for carrying said grinding wheel;

a rotatable motor means mounted on said second frame; and belt and pulley elements connecting said shaft to said rotatable motor means for rotating said grinding wheel.

6. A portable machine suitable for transport to the location of reel type mower units at a mowing site for refurbishing cutting edges of cutting elements of said reel type mower units, said machine comprising:

a base means adapted for resting on ground adjacent said mower units, said base means being a rectangular base frame carrying a pair of inverted V-shaped transverse guide members, one guide member along a front edge of said base frame and a further guide member along a rear edge of said base frame;

a substantially planar transport carriage provided with rollers for engagement with said guide members whereby said carriage is adapted for back and forth movement along the length of said guide members;

a forward and a rear base mount attached to said transport carriage;

first and further parallel cylindrical slideways joined between said forward and rear base mounts in an orientation perpendicular to said guide members and parallel to said transport carriage;

a first adjustment frame slidably engaged with said slideways, said first adjustment frame having a first end oriented toward said forward base mount and a further end oriented toward said rear base mount;

a traveling nut carried by and attached to said first adjustment frame;

a first rotatable screw having first and further ends threadably engaged with said traveling nut, said first screw rotatably supported in said forward and rear base mounts, respectively, whereby rotation of said first screw moves said first adjustment frame along said slideways;

a first handle attached to said further end of said first screw rearward of said rear base mount for achieving rotation of said first screw;

a further adjustment frame having a first end oriented toward said first end of said first adjustment frame, and a further end pivotally mounted to said further end of said first adjustment frame;

an elongated guide bracket provided with a longitudinal slot having a first end pivotally attached proximate said first end of said first adjustment frame, said slot engaging a projection proximate said first end of said further adjustment frame;

an internally threaded sleeve attached to said further adjustment frame proximate said first end thereof;

a further rotatable screw threadably engaged with said sleeve, having a first end bearing against said carriage, and a further end carrying a handle to provide for rotation of said further screw to effect changes in angular relationship of said further adjustment frame and said first adjustment frame;

a pair of parallel support arms having first ends attached to said further adjustment frame and further ends projecting beyond said first end of said further adjustment frame, each of said further ends being provided with a shaft support member;

a rotatable shaft carried by said support members, said shaft being provided with a grinding wheel pulley;

a grinding wheel attached to and rotatable by said shaft;

an arcuate guide member having an end for contact with said cutting element, said arcuate guide including means for attachment to said support arms and adjustment of said end at a selected position relative to a peripheral edge of said grinding wheel to effect a proper angle to said cutting edge during rotation of said grinding wheel;

a motor means mounted on said further adjustment frame proximate said further end thereof, said motor means including a rotatable shaft having a motor pulley attached thereto;

a drive belt engaged with said motor pulley and said grinding wheel pulley;

a pair of brackets each having a first end attached proximate opposite ends of said front edge of said base frame and extending outwardly therefrom to a further end provided with a transverse aperture;

an elongated rod carried by said apertures in said brackets; and a pair of pivotal attachment arms, each having a first end provided with first aperture to slidably receive said elongated rod, and a further end provided with further apertures to receive fasteners for attachment of said further ends to a frame of said mower units.

7. The grinding machine of claim 6 wherein said arcuate guide is provided with an end portion to contact said cutting element, and means for adjustably positioning said arcuate guide along a circle corresponding to the radius of said arcuate guide.

8. The grinding machine of claim 7 wherein said arcuate anvil is provided with a longitudinal slot and wherein said means for positioning said arcuate anvil comprises a releasable threaded element passing through said slot and into a support member for said grinding wheel.

* * * * *